US008695948B2

(12) United States Patent
Stinson

(10) Patent No.: US 8,695,948 B2
(45) Date of Patent: Apr. 15, 2014

(54) RAILING ASSEMBLY

(76) Inventor: William H. Stinson, Troy, MI (US)

( * ) Notice: Subject to any disclaimer, the term of this patent is extended or adjusted under 35 U.S.C. 154(b) by 129 days.

(21) Appl. No.: 12/730,173

(22) Filed: Mar. 23, 2010

(65) Prior Publication Data

US 2011/0233498 A1 Sep. 29, 2011

(51) Int. Cl.
*E04H 17/14* (2006.01)

(52) U.S. Cl.
USPC ..... 256/67; 256/65.12; 256/64

(58) Field of Classification Search
USPC ..... 256/22, 59, 65.01, 66, 67, 19, 21, 256/65.12, 65.13
See application file for complete search history.

(56) References Cited

U.S. PATENT DOCUMENTS

| | | | | |
|---|---|---|---|---|
| 2,218,953 | A * | 10/1940 | Gustafson | 256/22 |
| 3,414,236 | A * | 12/1968 | Siegal | 256/22 |
| 3,506,243 | A * | 4/1970 | Seiler | 256/59 |
| 3,918,686 | A * | 11/1975 | Knott et al. | 256/59 |
| 4,805,879 | A * | 2/1989 | Spera | 256/65.12 |
| 5,660,378 | A * | 8/1997 | Schall | 256/65.12 |
| 6,375,166 | B1 * | 4/2002 | Schall et al. | 256/65.08 |
| 6,752,385 | B2 * | 6/2004 | Zen et al. | 256/65.01 |
| 6,752,386 | B1 * | 6/2004 | Bundy | 256/65.12 |
| 6,796,549 | B1 * | 9/2004 | Lester | 256/59 |
| 6,874,766 | B2 * | 4/2005 | Curatolo | 256/59 |
| D562,992 | S * | 2/2008 | Szczekocki | D25/121 |
| 7,384,025 | B2 * | 6/2008 | Lo | 256/65.08 |
| 7,438,284 | B2 * | 10/2008 | McGinness et al. | 256/59 |
| 7,543,802 | B2 * | 6/2009 | Petta et al. | 256/65.08 |
| 7,635,115 | B2 * | 12/2009 | Lehmann | 256/65.12 |
| 7,677,535 | B1 * | 3/2010 | Lo | 256/65.08 |
| 7,744,065 | B2 * | 6/2010 | Terrels et al. | 256/59 |
| 8,413,965 | B2 * | 4/2013 | Duffy et al. | 256/65.12 |
| 2005/0127344 | A1 * | 6/2005 | Graber | 256/22 |
| 2008/0121857 | A1 * | 5/2008 | Lo | 256/65.01 |
| 2009/0065755 | A1 * | 3/2009 | Sherstad | 256/22 |
| 2009/0134377 | A1 * | 5/2009 | Petta et al. | 256/65.01 |
| 2010/0155683 | A1 * | 6/2010 | Payne et al. | 256/67 |
| 2010/0200827 | A1 * | 8/2010 | Duffy et al. | 256/67 |
| 2010/0252793 | A1 * | 10/2010 | Ash | 256/65.02 |
| 2011/0042637 | A1 * | 2/2011 | Howard et al. | 256/22 |
| 2013/0181179 | A1 * | 7/2013 | Langenwalter et al. | 256/67 |

* cited by examiner

*Primary Examiner* — Joshua Kennedy
(74) *Attorney, Agent, or Firm* — Gifford, Krass, Sprinkle, Anderson & Citkowski, P.C.

(57) ABSTRACT

An improved railing assembly is comprised of a plurality of pickets, a top rail, an inner rail and a bottom rail. The inner rail is pivotally attached to the pickets with fasteners. The fasteners are hidden from view by the top rail. Stiffeners project from the top rail and from the bottom rail. The stiffeners each either interface with another stiffener or a seat on the inner rail to provide rigidity to the assembly. The bottom of the railing assembly is substantially covered by the bottom rail. The angle between the pickets and the top rail is adjustable such that the pickets may be vertically oriented, while the top rail is parallel to a sloped terrain upon which the railing assembly is installed.

8 Claims, 3 Drawing Sheets

RAILING ASSEMBLY

BACKGROUND OF THE INVENTION

Traditional railing assemblies are comprised of vertically oriented pickets attached by one or more rails. While the pickets penetrate intermediate level rails, they often do not penetrate the top rail. In many railing configurations the top rail is intended to be gripped by a user in order to provide stability to the user.

One objective of the improved railing assembly described herein is to provide a top rail subassembly for a railing assembly. In other words, the railing assembly has as one of its components a top rail subassembly. One of the components of the top rail subassembly is a top rail. The railing assembly should be capable of maintaining a range of picket to top rail angles. This allows the railing to be installed upon sloped terrain with the pickets vertically oriented and the rails parallel to the sloped terrain. Others have accomplished this objective by using multi-component rail assemblies. One of the components is pivotally attached to the pickets. The second component (i.e., an upper rail component) is pivotally attached to the first component. For example, see U.S. Pat. No. 6,752,385 issued to Zen et al. and U.S. Pat. No. 7,384,025 issued to Lo.

The improved railing assembly described herein has a number of advantages compared to prior art railing assemblies. It allows a visible top rail to slide relative to a hidden inner rail. This allows enhanced outer rail to picket angle adjustability. The fasteners attaching the hidden inner rail to the pickets are hidden from view and contained within a recess within the inner rail. The bottom of the top rail subassembly is covered by a bottom rail. This limits the ability of contaminants to enter into the sliding interfaces between the components. The bottom rail also provides a structure from which stiffeners project. Stiffeners on the top rail and the bottom rail interface with each other or with a seat on the inner rail in order to provide enhanced structural stability. Further, the top rail and the inner rail releasably snap together to provide quick and easy installation, as well as disassembly of the components. The top rail, inner rail and bottom rail configurations are such that they may be fabricated by an extrusion process such as aluminum extrusion.

BRIEF SUMMARY OF THE INVENTION

The railing assembly described herein is comprised of a plurality of pickets, a top rail, an inner rail, and a bottom rail. Preferably, the top rail forms the top horizontal rail of a railing.

The pickets are traditional railing pickets. They typically have a rectangular, square or round cross-section. The pickets used in a railing are substantially vertically oriented with a typical spacing of 3¾" between the pickets.

The top rail of a railing assembly is substantially horizontally oriented and forms the upper periphery of a railing assembly. When the railing is located upon an incline, the top rail is preferably inclined to follow the contour of the terrain. The top rail has at least two upper stiffeners. When the top rail is mounted to the pickets the stiffeners project downwardly toward the terrain. Each stiffener is adapted to mate with a corresponding lower stiffener on the bottom rail or a seat on the inner rail. The top rail also has a pair of snaps. These snaps are adapted to releasably mate with a corresponding pair of snaps on the bottom rail.

The inner rail attaches to the pickets with fasteners such as screws. Preferably, when the inner rail is fastened to the pickets the inner rail may pivot about the fasteners. The inner rail has an upper seat and a lower seat. The upper seat is adapted to receive a stiffener from the top rail. The lower seat is adapted to receive a stiffener from the bottom rail.

The bottom rail has at least two lower stiffeners. When the bottom rail is mounted to the pickets, the lower stiffeners project upwardly toward the top rail. The lower stiffeners are each adapted to mate with either a corresponding upper stiffener of the top rail or a seat on the inner rail. The bottom rail has one or more picket openings. Each picket is inserted through an opening in the bottom rail. The pickets are pivotally attached to the inner rail. The picket openings are preferably larger than the cross-section of the pickets. This allows the pickets to rack through varying angles with respect to the top rail and the inner rail. In other words, the angle between the pickets and the rails may be adjusted so that the pickets may be vertically oriented, while the rails follow the contour of the terrain. The oversizing of the bottom rail openings with respect to the pickets allows the angling of the pickets with respect to the rails. The bottom rail has a pair of lower snaps. The lower snaps are adapted to releasably mate with the upper snaps of the top rail. Each upper snap is snapped into a lower snap to releasably secure the top rail to the bottom rail.

The first upper stiffener of the top rail is shaped and sized to mate with the first lower stiffener of the bottom rail. The second upper stiffener of the top rail is shaped and sized to mate with the upper seat of the inner rail. The second lower stiffener of the bottom rail is shaped and sized to mate with the lower seat of the inner rail.

Optionally, the upper rail may form an enclosed volume. In this configuration a base closes the bottom side of the top rail to form the enclosed volume. The upper stiffeners of the top rail project downwardly from the base.

End caps may be used to close off the ends of the rails. The top rail may be provided with one or more fastener bosses. The fastener bosses are adapted to receive a fastener, such as a screw. This will allow the end cap to be fastened onto or screwed onto the top rail.

Preferably, each inner rail seat is comprised of a horizontal member and a vertical member. Horizontal and vertical refer to the orientation of the seat components on a completed railing assembly. The horizontal member and the vertical member should form a right angle with each other.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
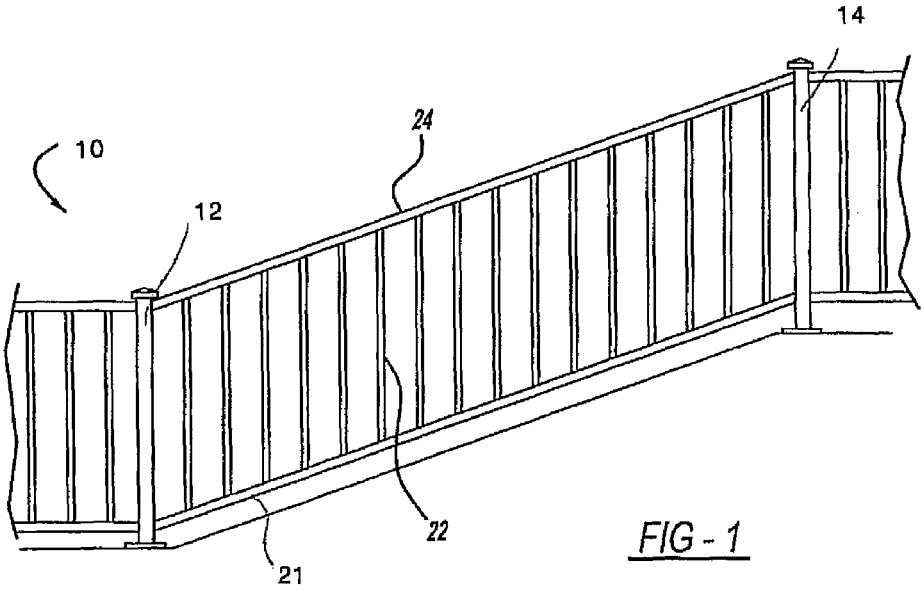
FIG. 1 is a front view of a railing assembly.
Figure 2:
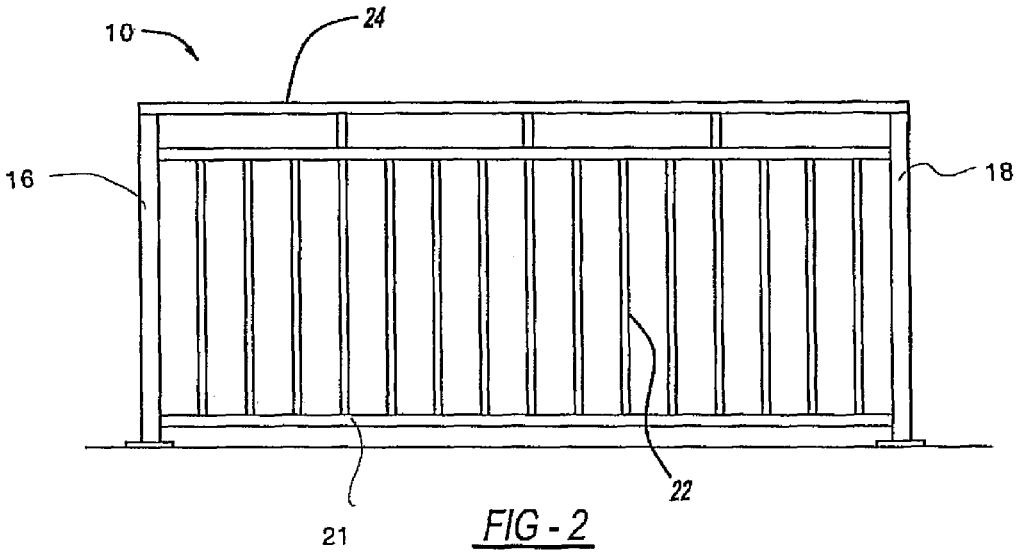
FIG. 2 is a front view of a second embodiment of a railing assembly.

FIGS. 1-2 depict first 10 and second 10' examples, respectively, of fencing constructions incorporating the railing assembly of the present invention. As shown, mounting posts 12 and 14 (FIG. 1) and 16 and 18 (FIG. 2) engage ground locations in spaced apart fashion to support the upper and lower rails and intersecting pickets as will be further described in reference to FIGS. 3-6.

As previously stated, an inter-slidable relationship established between a top rail and a hidden inner rail of either upper or lower rail subassemblies permits enhanced outer rail to picket angle adjustability which is in response to variations in elevation of the mounting posts 12 & 14 in FIG. 1 as compared to 16 & 18 in FIG. 2.

With further reference to FIGS. 3-6, a series of plan cutaway views are shown of top rail subassemblies at 20, 20', 20" and 20'" respectively. For purposes of ease of illustration and description, similar features common to each variant will be identically numbered and described.

Figure 3:
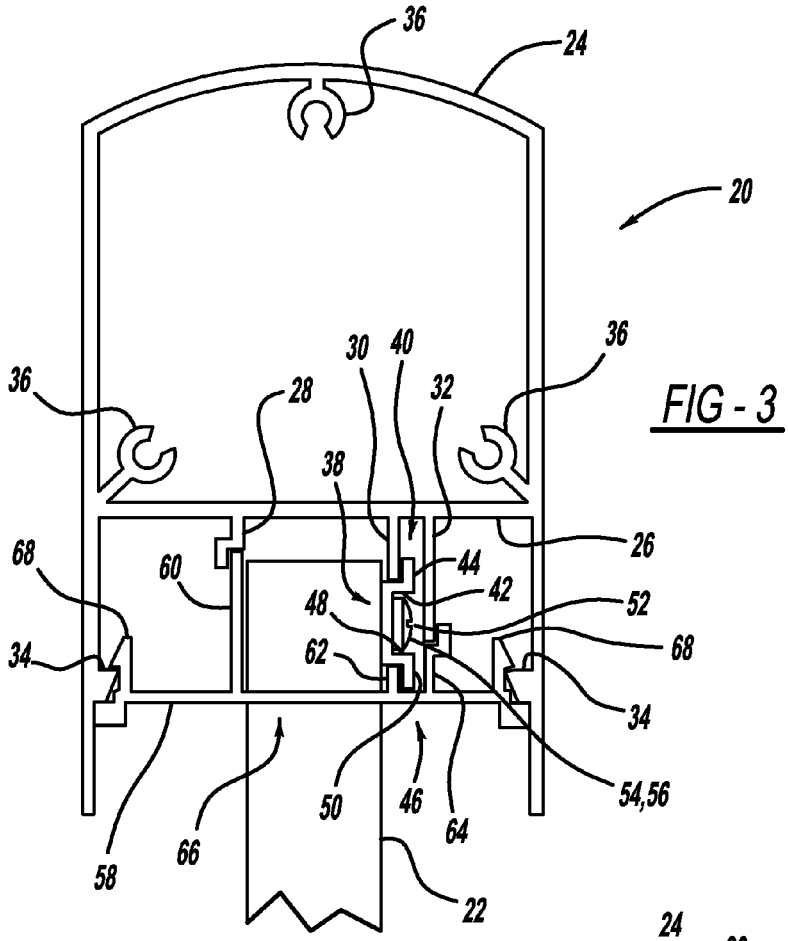
FIG. 3 is a side sectional view of a first embodiment of a railing assembly.

A first embodiment of a railing assembly incorporating top rail subassembly 20 is shown in FIG. 3. The top rail subassembly is used to form the top horizontal rail of the railing assembly, as shown in FIG. 1 and FIG. 2. The top rail subassembly may be modified for use as a horizontal rail which is not positioned at the top of a railing assembly, but rather between the top and the bottom, by ensuring that it has a picket opening which would allow a picket 22 to extend completely through the railing subassembly. When the top rail subassembly is used to form the top horizontal rail of fencing construction 10 or 10', its upper portion is comprised of a closed surface which is not penetrable by a picket 22.

Referring again to FIG. 1 and FIG. 2 the variations of the top rail subassemblies 20, in combination with a bottom rail 21 and the intersecting plurality of pickets 22 are illustrated as supported by the vertical posts 12 & 14 and 16 & 18. The top rail subassembly in FIG. 1 and FIG. 2 forms the upper periphery of the railing assembly 20. The top rail subassembly 20 is comprised of a top rail 24, an inner rail 38 and a bottom rail 58 secured to a plurality of pickets 22. The fencing 10 and 10' shown in FIG. 1 and FIG. 2 has a bottom rail subassembly 21. It should be clear that a top horizontal rail subassembly may be used as a bottom horizontal rail subassembly by turning the components of the subassembly upside down. For example, the rail subassembly illustrated in FIG. 6 may be used as a bottom horizontal rail subassembly by affixing the components of the subassembly to the bottom aspect of the pickets. This can be visualized by visualizing an upside down version of FIG. 6. In such a version the top rail 24 would form the lower periphery of the railing assembly 20 illustrated in FIG. 1 and FIG. 2. The rail subassembly illustrated in FIG. 5 may be used as a bottom horizontal rail subassembly without reversing its orientation. In this case a picket opening would be needed on the top rail 24.

The preferred railing assembly 20 is comprised of a plurality of pickets 22, a top rail 24, an inner rail 38 and a bottom rail 58.

The pickets 22 are conventional railing pickets. In a railing assembly 20 they are vertically oriented. Typically, the pickets 22 have a rectangular, square or round cross-section. They may be extruded from aluminum. Aluminum is extrudable, light weight, has a relatively low cost and is resistant to oxidation. A typical separation distance between pickets 20 within a railing assembly 20 is 3¾". The top rail 24, the inner rail 38 and the bottom rail 58 may each also be extruded from aluminum.

The inner rail 38 is fastened to a plurality of pickets 20. One screw 54 may be used to fasten the inner rail 38 to each picket 20. Each picket 20 may then pivot about the screw 54 with respect to the inner rail 38. Thus, the angle between a picket 20 and the inner rail 38 is adjustable.

Figure 4:
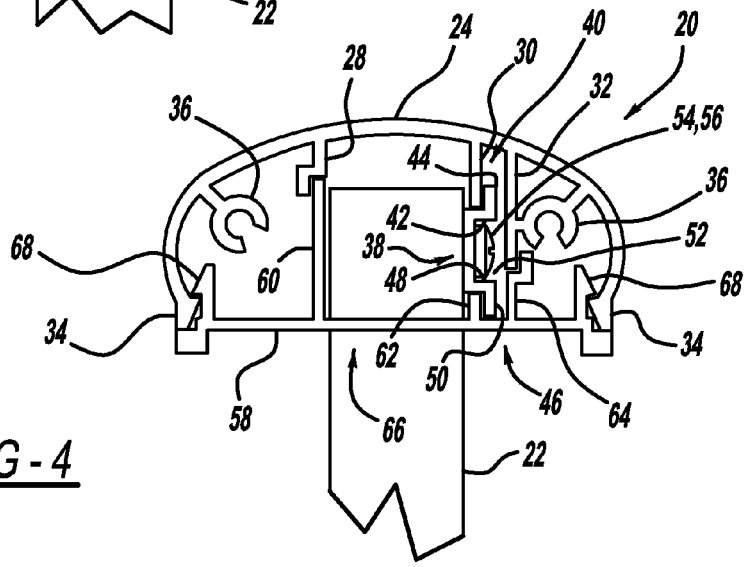
FIG. 4 is a side sectional view of a second embodiment of a railing assembly.
Figure 5:
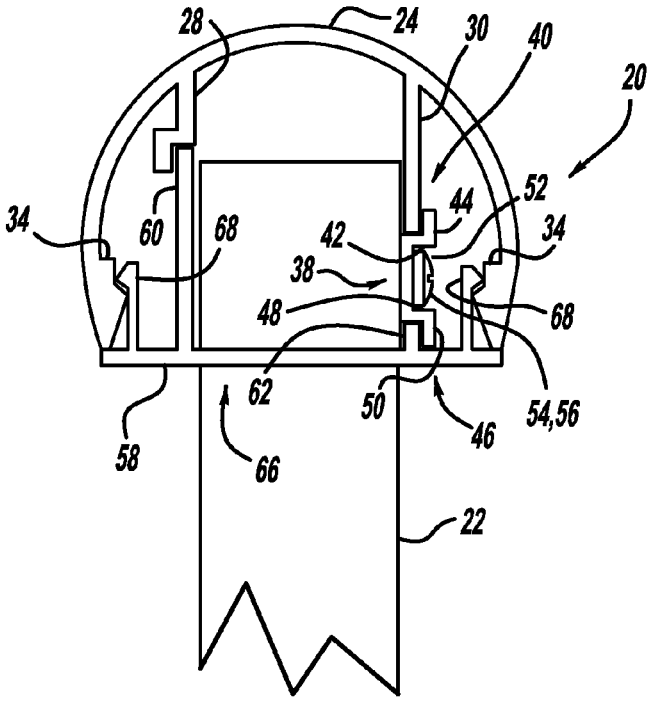
FIG. 5 is a side sectional view of a third embodiment of a railing assembly.
Figure 6:
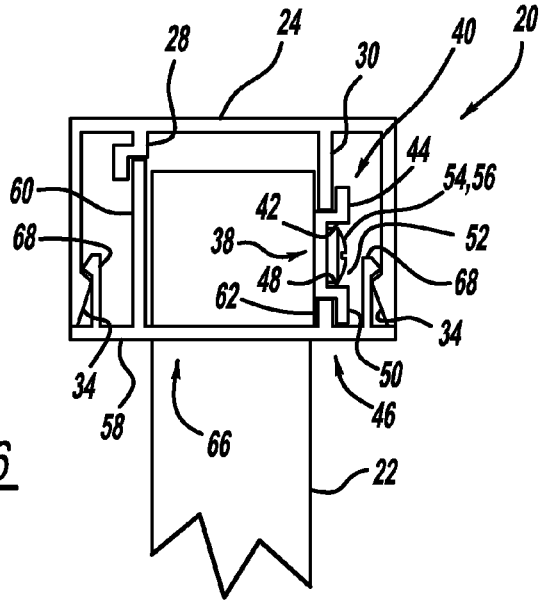
FIG. 6 is a side sectional view of a fourth embodiment of a railing assembly, which may be used either as a top railing or a bottom railing.

The top rail 24 may be open at its bottom, as shown in FIG. 4, FIG. 5 and FIG. 6. Alternatively, a base 26 on the bottom aspect of the top rail 24 may be used to enclose a volume within the top rail 24. This is shown in FIG. 3. There, the top rail 24 is a hollow closed structure. The top rail 24 has a first upper stiffener 28, a second upper stiffener 30, a third upper stiffener 32 and a pair of upper snaps 34. The stiffeners 28, 30, 32 project downwardly from the top rail 24. In the configuration using the base 26, the stiffeners 28, 30, 32 project downwardly from the base 26. The referenced orientations are with respect to an installed railing when a top rail subassembly is used to form a top horizontal rail of a railing assembly 20. The bottom aspect of the top rail 24 is that aspect of the top rail 24 which is nearer to the ground. The downward direction is the direction extending from the top rail 24 to the ground. The referenced orientations must be appropriately modified when a top rail subassembly is used to form a bottom horizontal rail of a railing assembly 20. The claims should be read with this understanding. In other words, a top rail is actually a bottom rail with upwardly projecting stiffeners, instead of downwardly projecting stiffeners, when a top rail subassembly is used to form a bottom horizontal rail of a railing assembly 20. Similarly, a bottom rail is actually a top rail with downwardly projecting stiffeners, instead of upwardly projecting stiffeners, when the top rail subassembly is used to form a bottom horizontal rail of a railing assembly 20. The top rail stiffeners 28, 30, 32 (as well as the stiffeners 60, 62, 64 of the bottom rail 58) render the components of the railing assembly 20 more rigid and durable. The stiffeners 28, 30, 32, 60, 62, 64 may be fabricated by extruding the top rail 24 and the bottom rail 58 to have the stiffener configurations shown in FIGS. 3-6.

The upper snaps 34 are positioned on opposite ends of the top rail 24, as shown in FIGS. 3-6. The upper snaps 34 are adapted to releasably snap into corresponding lower snaps 68 on the bottom rail 58. The upper snaps 34 have an angled surface which, during installation of the top rail 24 onto the bottom rail 58, engages with a corresponding angled surface of a lower snap 68 on the bottom rail 58. During installation of the top a rail 24 onto the bottom rail 58 the angled surface of the lower snap 68 forces the upper snap 34 in a lateral direction. After further downward installation motion of the top rail 24, the upper snap 34 springs back into a recess within the lower snap 68 and releasably locks the top rail 24 to the bottom rail 58.

The ends of the top rail 24 should be closed. The ends may be closed with an end cap. The end cap may be fastened to the top rail 24 with a fastener, such as a screw. To facilitate a screw attachment between the end cap and the top rail 24, the top rail 24 is provided with one or more fastener bosses 36, as shown in FIG. 3 and FIG. 4. The fastener bosses 36 may be formed into the top rail 24 during the extrusion fabrication process of the top rail 24. The fasteners 54 attach to a fastener boss 36. If the fastener is a screw, the screw screws into the fastener boss 36 in order to secure the end cap to the top rail 24. The end cap should have sufficient surface area to also cover the cross-sectional area of the bottom rail 58 of a railing assembly.

The inner rail 38 is shaped as a strip. It has an upper seat 40 and a lower seat 46. It functions to pivotally attach itself to the pickets 20, as well as to provide an upper seat 40 and a lower seat 46 for receiving a stiffener from the top rail 24 and the bottom rail 58, respectively. Preferably, the upper seat 40 is sized and shaped to receive the second upper stiffener 30 of the top rail 24 and the lower seat 46 is shaped and sized to receive the second lower stiffener 62 of the bottom rail 58. The inner rail seats 40, 46 should each be comprised of a horizontal member 42, 48 and a vertical member 44, 50, as shown in FIG. 3. The horizontal member 42, 48 and the vertical member 44, 50 form a right angle. The result is an orthogonal U-shaped upper seat 40 and an orthogonal U-shaped lower seat 46. Each seat 40, 46 forms a U-shaped receptacle with a picket 20, as shown in FIG. 3. This U-shaped receptacle has an interior opening which is slightly wider than the width of the stiffener 30, 62 with which it mates. The interface between the stiffeners 30, 62 and the inner rail seats 40, 46 is adapted to permit the top rail 24 and the bottom rail 58 to slide along the seats 40, 46 in a direction parallel to the longitudinal axis of the top rail 24 and the longitudinal axis of the bottom rail 58. The referenced direction is the direction into and out of the paper with respect to FIG. 3. However, the interface between the stiffeners 30, 62 and the inner rail seats 40, 46 is adapted to limit movement of the top rail 24 and the bottom rail 58 in other directions, including the directions orthogonal to said longitudinal axes.

In the preferred embodiment of the railing assembly 20 the inner rail 38 has a fastener recess 52 positioned between the upper seat 40 and the lower seat 46, as shown in FIG. 3. The recess should have sufficient depth such that the head 56 of a fastener 54 positioned within the recess 52, in order to secure the inner rail 38 to a picket 20, is enclosed within the recess 52. In other words, if a screw 54 is used to attach the inner rail 38 to a picket 20, the head 56 of the screw 54 should not protrude from the recess 52. The inner rail 38 is fastened to the plurality of pickets 20 with one or more fasteners 54. The heads 56 of each fastener 54 are enclosed within the recess 52. This secures the pickets 20 to each other, but allows the angle between a picket 20 and the inner rail 38 to be varied.

The bottom rail 58 has a first lower stiffener 60, a second lower stiffener 62, a third lower stiffener 64, at least one picket opening 66 and a pair of lower snaps 68. The lower stiffeners 60, 62, 64 project upwardly from the bottom rail 58. The lower snaps 68 are positioned on opposite ends of the bottom rail 58, as shown in FIGS. 3-6. Each upper snap 34 is adapted to releasably mate with a lower snap 68, as previously described. The picket openings 66 receive the pickets 20. The picket openings 66 should be sufficiently enlarged with respect to the sectional dimensions of the pickets 20 in order to allow the angle between the inner rail 38 and the pickets 20 to be adjusted so that the top rail 24 may be substantially parallel to the terrain upon which the railing is installed, while the pickets 20 are substantially vertically oriented. Each picket 20 is positioned through a picket opening 66 in the bottom rail 58, as shown in FIGS. 3-6. The first lower stiffener 60 of the bottom rail 58 is positioned adjacent to one side of the pickets 20. The second lower stiffener 62 of the bottom rail 58 is positioned adjacent to the opposite side of the pickets 20, as shown in FIGS. 3-6. Positioning the first lower stiffener 60 and the second lower stiffener 62 in close proximity to the pickets 20 stabilizes the railing assembly 20 and minimizes movement between the pickets 20 and the rails 24, 38, 58 after installation. The top rail 24 is attached to the bottom rail 58 by snapping the top rail 24 onto the bottom rail 58. As a result, the railing assembly 20 has a closed bottom and top. The rails 24, 38, 58 are attached to each other. The angle between the rails 24, 38, 58 and the pickets 22 may be adjusted. The resulting railing assembly 20 structure is rigid and durable, yet it may be easily disassembled by unsnapping the top rail 24 from the bottom rail 58.

Each upper stiffener 28, 30, 32 and each lower stiffener 60, 62, 64 is shaped and sized so that it may mate with a stiffener on a counterpart rail, or an inner rail 38 seat 40, 46. That is to say, each upper stiffener 28, 30, 32 may mate with one lower stiffener 60, 62, 64. A stiffener may also mate with an inner rail 38 seat 40, 46. In FIG. 3 the first upper stiffener 28 mates with the first lower stiffener 60. The second upper stiffener 30 mates with the upper seat 40 of the inner rail 38. The second lower stiffener 62 mates with the lower seat 46 of the inner rail 38. The third upper stiffener 32 mates with the third lower stiffener 64. Preferably, when an upper stiffener 28, 30, 32 mates with a lower stiffener 60, 62, 64 one of the stiffeners is provided with a seat for receiving the other stiffener. This is illustrated in FIG. 3. There, the first upper stiffener 28 is provided with a seat for receiving the first lower stiffener 60. The seat may consist of simply a right angle jog in the linearity of the stiffener, as shown with respect to the first upper stiffener 28 in FIG. 3. There, the first upper stiffener 28 provides a base for the first lower stiffener 60 edge to rest upon. The first upper stiffener 28 also provides a vertically oriented structure which limits horizontal movement in one direction of the bottom rail 58. A similar interface between the third upper stiffener 32 and the third lower stiffener 64 is also shown in FIG. 3. It should be apparent, that with respect to an upper stiffener and a lower stiffener interface, either stiffener can provide the seat. The first upper stiffener 28 of the top rail 24 is shaped and sized to mate with the first lower stiffener 60 of the bottom rail 58 such that vertical and horizontal movement between the top rail 24 and the bottom rail 58 is limited. The second upper stiffener 30 of the top rail 24 is shaped and sized to mate with the upper seat 40 of the inner rail 38 such that vertical and horizontal movement between the inner rail 38 and the top rail 24 is limited. The second lower stiffener 62 of the bottom rail 58 is shaped and sized to mate with the lower seat 46 of the inner rail 38 such that vertical and horizontal movement between the inner rail 38 and the bottom rail 58 is limited. The third upper stiffener 32 of the top rail 24 is shaped and sized to mate with the third lower stiffener 64 of the bottom rail 58 such that vertical and horizontal movement between the top rail 24 and the bottom rail 58 is limited.

Although FIG. 3 shows three stiffeners 28, 30, 32 on the top rail 24 and three stiffeners 60, 62, 64 on the bottom rail 58, the railing assembly may be fabricated with more than three or less than three stiffeners on each rail 24, 58. The alternate embodiment of a railing assembly 20 illustrated in FIG. 5 employees only two upper stiffeners 28, 30 on the top rail 24 and two lower stiffeners 60, 62 on the bottom rail 58. Similarly, the top rail 24 and the bottom rail 58 of the alternate embodiment of a railing assembly 20 illustrated in FIG. 6 each have only two stiffeners 28, 30, 60, 62.

Although the invention has been shown and described with reference to certain preferred embodiments and methods, those skilled in the art undoubtedly will find alternative embodiments and methods obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A railing assembly incorporated into a fencing construction including spaced apart and ground engaging mounting posts, said railing assembly comprising:

a top rail subassembly adapted to extend between upper locations of the mounting posts;

a bottom rail subassembly adapted to extend between lower locations of the mounting posts;

a plurality of pickets secured in extending fashion between said top and bottom rail subassemblies;

at least one of said top and bottom rail subassemblies further including an exposed rail slidably mounted relative to a hidden inner rail affixed to ends of said pickets, allowing for rail to picket angle adjustability in response to variations in elevation of the mounting posts; and a strip-shaped component mounted within said inner rail in side contacting fashion with said pickets, said strip component having upper and lower seating locations for receiving a first selected pair of stiffeners extending from said exposed and inner rails, a second spaced apart and selected pair of stiffeners supporting an opposite side of said pickets.

2. The railing assembly as described in claim 1, further comprising a plurality of fastener bosses configured upon inside locations of said exposed rail in order to facilitate attachment of an end cap.

3. The railing assembly as described in claim 1, said exposed rail further comprising a base, a plurality of stiffeners extending from said base and slidably abutting a like plurality of stiffeners extending in opposing fashion from a bottom of said inner rail.

4. The railing assembly as described in claim 3, further comprising upper snaps configured in inwardly extending fashion along outer spaced apart side walls of said exposed rail, said inner rail having lower snaps configured in outwardly extending fashion from said bottom which slidably support against said upper snaps.

5. The railing assembly as described in claim 3, said bottom of said inner rail further comprising a length extending openings for receiving said ends of said pickets.

6. The railing assembly as described in claim 1, further comprising a fastener recesses configured in said strip shaped component for receipt therethrough of fasteners for securing said inner rail to said pickets.

7. The railing assembly as described in claim 1, said exposed rail further comprising any of a rectangular, circular or ovular shape in cross section.

8. The railing assembly as described in claim 1, further comprising each of said top and bottom rail subassemblies and said pickets being constructed of an extruded aluminum.

* * * * *